US011488554B2

(12) United States Patent
Lei et al.

(10) Patent No.: US 11,488,554 B2
(45) Date of Patent: Nov. 1, 2022

(54) SYSTEMS AND METHODS FOR GENERATING AN OVERDRIVE LOOK-UP TABLE (LUT) FOR RESPONSE TIME COMPENSATION OF A DISPLAY DEVICE

(71) Applicant: Dell Products, L.P., Round Rock, TX (US)

(72) Inventors: Guo Lei, Singapore (SG); Siew Fei Lee, Singapore (SG)

(73) Assignee: Dell Products, L.P., Round Rock, TX (US)

( * ) Notice: Subject to any disclaimer, the term of this patent is extended or adjusted under 35 U.S.C. 154(b) by 379 days.

(21) Appl. No.: 16/871,601

(22) Filed: May 11, 2020

(65) Prior Publication Data

US 2021/0349355 A1 Nov. 11, 2021

(51) Int. Cl.
*G09G 3/20* (2006.01)
*G09G 3/36* (2006.01)

(52) U.S. Cl.
CPC ..... *G09G 3/3611* (2013.01); *G09G 3/2092* (2013.01); *G09G 2320/0252* (2013.01); *G09G 2340/16* (2013.01); *G09G 2360/18* (2013.01)

(58) Field of Classification Search
CPC ..... G09G 2340/0435; G09G 2340/16; G09G 2320/0252; G09G 3/36–3696
See application file for complete search history.

(56) References Cited

U.S. PATENT DOCUMENTS

| | | | | |
|---|---|---|---|---|
| 7,382,349 | B1 * | 6/2008 | Kuhns | G09G 3/3685 345/204 |
| 7,701,451 | B1 * | 4/2010 | Daewon | G09G 3/3611 345/589 |
| 7,804,470 | B2 * | 9/2010 | Poon | G09G 3/3611 345/87 |
| 8,049,741 | B2 * | 11/2011 | Knepper | G09G 3/3611 345/98 |
| 8,212,799 | B2 * | 7/2012 | Kerwin | G09G 3/3611 345/94 |
| 10,147,370 | B2 * | 12/2018 | Verbeure | G09G 3/3611 |
| 10,438,561 | B2 * | 10/2019 | Shehata | G09G 5/06 |
| 10,453,432 | B2 * | 10/2019 | Lin | G09G 5/391 |
| 11,004,412 | B2 * | 5/2021 | Xiao | G09G 3/3618 |
| 11,195,485 | B1 * | 12/2021 | Wu | G09G 3/3607 |
| 2008/0068318 | A1 * | 3/2008 | Kerwin | G09G 3/3611 345/89 |
| 2008/0231624 | A1 * | 9/2008 | Poon | G09G 3/3611 345/212 |
| 2011/0063330 | A1 * | 3/2011 | Bae | G09G 3/3611 345/88 |

(Continued)

*Primary Examiner* — Patrick F Marinelli
(74) *Attorney, Agent, or Firm* — Fogarty LLP

(57) ABSTRACT

Systems and methods are provided for generating an overdrive look-up table (LUT) for response time compensation of a display device are described. In some embodiments, an Information Handling System (IHS) may include a controller and a memory coupled to the controller, the memory having program instructions stored thereon that, upon execution, cause the controller to generate a Look-up Table (LUT) of alternate grey levels selected to implement Response Time Compensation (RTC) in a Liquid Crystal Display (LCD), where at least one of the alternate grey levels is calculated, at least in part, by taking into account a frame rate of a video stream.

14 Claims, 7 Drawing Sheets

(56) References Cited

U.S. PATENT DOCUMENTS

| | | | | |
|---|---|---|---|---|
| 2011/0164076 | A1* | 7/2011 | Lee | G09G 3/3677 345/698 |
| 2017/0124934 | A1* | 5/2017 | Verbeure | G09G 3/3611 |
| 2018/0090109 | A1* | 3/2018 | Lin | G09G 5/391 |
| 2019/0189082 | A1* | 6/2019 | Shehata | G09G 5/026 |
| 2021/0110778 | A1* | 4/2021 | Xiao | G09G 3/3618 |
| 2021/0349355 | A1* | 11/2021 | Lei | G09G 3/3611 |
| 2022/0036844 | A1* | 2/2022 | Chen | G09G 3/36 |
| 2022/0180793 | A1* | 6/2022 | Wang | G09G 3/3607 |

* cited by examiner

| 17x17 OD LUT | | TO | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| FROM | 0 | | 21 | 46 | 65 | 81 | 118 | 130 | 153 | 172 | 197 | 220 | 223 | 247 | 248 | 255 | 255 | 255 |
| | 16 | 0 | | 37 | 58 | 78 | 107 | 123 | 147 | 165 | 190 | 212 | 219 | 242 | 244 | 255 | 255 | 255 |
| | 32 | 0 | 11 | | 52 | 73 | 100 | 119 | 140 | 159 | 185 | 209 | 215 | 236 | 242 | 255 | 255 | 255 |
| | 48 | 0 | 9 | 26 | | 68 | 96 | 113 | 135 | 153 | 179 | 204 | 211 | 233 | 239 | 255 | 255 | 255 |
| | 64 | 0 | 8 | 21 | 41 | | 84 | 108 | 129 | 149 | 174 | 199 | 108 | 230 | 236 | 255 | 255 | 255 |
| | 80 | 0 | 7 | 20 | 35 | 59 | | 102 | 124 | 146 | 169 | 195 | 204 | 227 | 233 | 255 | 255 | 255 |
| | 96 | 0 | 7 | 19 | 33 | 54 | 75 | | 118 | 141 | 163 | 187 | 198 | 223 | 231 | 255 | 255 | 255 |
| | 112 | 0 | 6 | 18 | 32 | 52 | 70 | 89 | | 134 | 157 | 175 | 195 | 220 | 229 | 252 | 255 | 255 |
| | 128 | 0 | 6 | 17 | 32 | 51 | 68 | 82 | 106 | | 150 | 168 | 189 | 217 | 226 | 249 | 255 | 255 |
| | 144 | 0 | 5 | 16 | 31 | 50 | 66 | 81 | 100 | 123 | | 162 | 185 | 212 | 223 | 245 | 255 | 255 |
| | 160 | 0 | 5 | 16 | 31 | 50 | 65 | 77 | 98 | 118 | 139 | | 180 | 205 | 219 | 241 | 255 | 255 |
| | 176 | 0 | 4 | 15 | 28 | 47 | 60 | 74 | 96 | 112 | 134 | 155 | | 198 | 216 | 237 | 255 | 255 |
| | 192 | 0 | 3 | 14 | 26 | 47 | 56 | 72 | 92 | 108 | 128 | 150 | 171 | | 213 | 233 | 251 | 255 |
| | 208 | 0 | 3 | 13 | 25 | 43 | 52 | 67 | 88 | 105 | 125 | 144 | 166 | 186 | | 230 | 248 | 255 |
| | 224 | 0 | 3 | 12 | 24 | 40 | 48 | 63 | 85 | 102 | 118 | 141 | 162 | 180 | 203 | | 245 | 255 |
| | 240 | 0 | 2 | 10 | 22 | 38 | 46 | 59 | 83 | 97 | 112 | 131 | 157 | 175 | 198 | 219 | | 255 |
| | 255 | 0 | 1 | 9 | 20 | 35 | 43 | 55 | 79 | 93 | 106 | 121 | 135 | 170 | 194 | 205 | 234 | |

200B

FIG. 2B

SYSTEMS AND METHODS FOR GENERATING AN OVERDRIVE LOOK-UP TABLE (LUT) FOR RESPONSE TIME COMPENSATION OF A DISPLAY DEVICE

FIELD

This disclosure relates generally to Information Handling Systems (IHSs), and more specifically, to systems and methods for generating an overdrive look-up table (LUT) for response time compensation of a display device.

BACKGROUND

As the value and use of information continues to increase, individuals and businesses seek additional ways to process and store information. One option is an Information Handling System (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, global communications, etc. In addition, IHSs may include a variety of hardware and software components that may be configured to process, store, and communicate information and may include one or more computer systems, data storage systems, and networking systems.

IHSs often include (or are coupled to) display devices, such as liquid crystal display (LCD) panels. LCD panels are progressively scanned, meaning that at any given time instant, partial frames of both the previous and current frame are visible on the screen along with a progressively moving tear boundary. This scan and hold characteristic is well-suited for the display of static image content, but is undesirable for the display of video that contains motion. In general, this is due to the inadequate pixel response times of LCD panels.

Each pixel in an LCD include a column of liquid crystal molecules suspended between two transparent electrodes that are in turn sandwiched between two polarizing filters whose axes of polarity are perpendicular to each other. By applying voltage to the transparent electrodes over each pixel, the corresponding liquid crystal molecules are "twisted" by electrostatic forces, allowing varying degrees of light to pass through the polarizing filters. Due to their electro-optical nature, the liquid crystal materials used in LCD panels have inertia and cannot be switched instantaneously. This results in transition response times that are generally not fast enough for high quality video applications. This slow response time, or latency, can result in video motion artifacts that cause quickly moving objects to appear visually blurred, an effect known as "ghosting" or "smearing."

LCD response times continue to improve, but vendor specifications are generally limited to "off-to-on," "rise and fall," or "black-to-white" response time, which is the time it takes a pixel to change from black to white (rise) and then back to black (fall). The voltage required to change an LCD pixel from black to white, or white to black is greater than the voltage to change a pixel from one shade of grey to another. This disparity in voltage differential is the reason "black-to-white" response time is much faster than "grey-to-grey" response time, which is defined as the time it takes a pixel to change from one shade of grey to another. Grey-to-grey response times for LCD panels can be many times longer (e.g., 30 to 50 ms.) than corresponding "black-to-white" response times.

Video frame rates are typically on the order of 17 ms at 60 Hz, which can be shorter than liquid crystal "grey-to-grey" response time. These frame rates, when combined with motion within the video frame, can result in video artifacts that cause smearing and low video quality. This problem extends to all LCD displays, but it is more of an issue for LCD panels used in portable IHSs due to their typically lower power consumption and correspondingly slow response times. In addition, due to limited battery life, power adapter capacity, cooling limitations, fan noise and other operational and design constraints, portable IHSs are generally designed to efficiently use computation cycles and minimize the associated overhead required to display an image.

Current approaches to address slow pixel response times include LCD Response Time Compensation (LRTC), a technique for mitigating video artifacts that can contribute to smearing when motion video is displayed on an LCD screen. LRTC addresses slow intrinsic response times by imposing an extrinsic overdrive voltage for each pixel to be written, based on the prior and next pixel values and the predetermined characteristics of an LCD panel.

SUMMARY

Systems and methods for generating an overdrive look-up table (LUT) for response time compensation of a display device are described. In an illustrative non-limiting embodiment, an Information Handling System (IHS) may include: a controller; and a memory coupled to the controller, the memory having program instructions stored thereon that, upon execution, cause the controller to generate a Look-up Table (LUT) of alternate grey levels selected to implement Response Time Compensation (RTC) in a Liquid Crystal Display (LCD), where at least one of the alternate grey levels is calculated, at least in part, by taking into account a frame rate of a video stream.

In some cases, at least one of the alternate grey levels may be calculated, at least in part, by taking into account a quantified measure of image motion artifacts. At least one of the alternate grey levels may be calculated, at least in part, by taking into account a Grey Level Response Time (GLRT) target. The LUT may be generated, at least in part, using: (i) a numerical integration technique, or (ii) definite integration technique. Additionally, or alternatively, the LUT may be generated, at least in part, by calculating each grey-to-grey transition native response time.

In some case, the LUT may be generated, at least in part, by calculating: (i) a luminance for each gray scale level, and (ii) an equivalent grey scale level at the end of a first frame following each grey-to-grey transition. Additionally, or alternatively, the LUT may be generated, at least in part, by: (i) setting an offset margin value; (ii) calculating the LUT using the offset margin value; and at least one of: (iii) in response to application of the LUT meeting the GLRT target, recording the LUT; or (iv) in response to application of the LUT not meeting the GLRT target, incrementing the offset margin value and recalculating the LUT using the incremented offset margin value.

In another illustrative, non-limiting embodiment, a memory storage device may have program instructions stored thereon that, upon execution by a controller of an LCD, cause the LCD to: receive a video stream; and generate an LUT of alternate grey levels selected to implement RTC, where at least one of the alternate grey levels is calculated, at least in part, by taking into account a quantified measure of image motion artifacts. In yet another illustrative, non-limiting embodiment, a method may include: receiving a video stream; and generating an LUT of alternate grey levels selected to implement RTC, where at least one of the alternate grey levels is calculated, at least in part, by taking into account: (i) a frame rate of a video stream, and (ii) a measure of image motion artifacts.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity, and have not necessarily been drawn to scale.

FIG. 2B is an example of an overdrive LUT, according to some embodiments.

DETAILED DESCRIPTION

Figure 1:
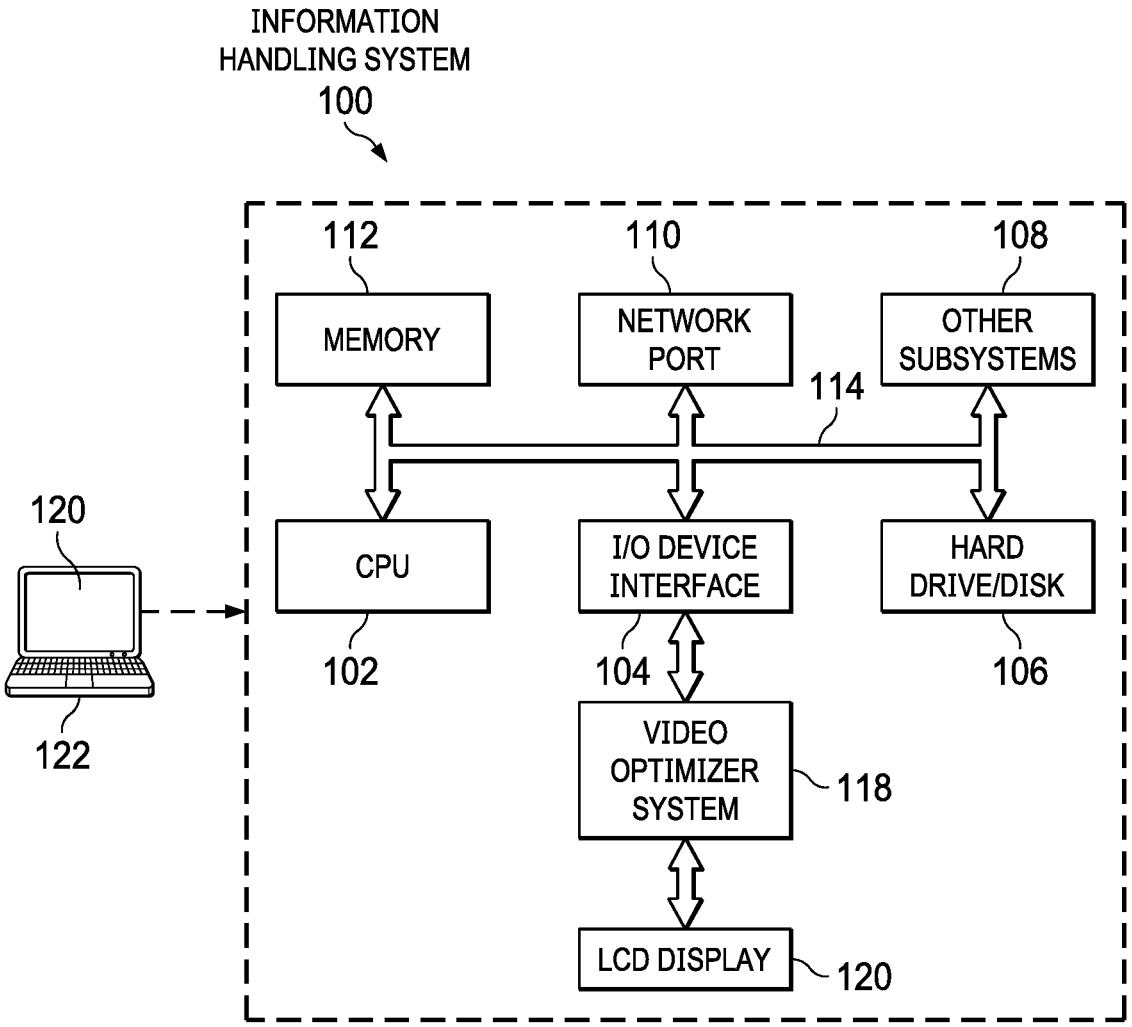
FIG. 1 is a block diagram illustrating an example of components of an Information Handling System (IHS) configured go generate an overdrive look-up table (LUT) for response time compensation of a display device, according to some embodiments.

In some embodiments, systems and methods for generating an overdrive look-up table (LUT) for response time compensation of a display device are described. As used herein, a "display device" may refer to an embedded, built-in component of an IHS (e.g., an integrated display the case of a laptop or tablet computer) or an independent, stand-alone device coupled to a desktop computer or server. In various implementations, an automated overdrive LUT may be configured to provide superior image quality in any display device by achieving fast response times while reducing or minimizing image artifacts.

As gaming and video production/editing applications become increasingly popular, response times of liquid crystal display (LCD) panels have attracted more attention. Response times are usually measured from grey-to-grey transitions, called as G-to-G response time or Grey Level Response Time (GLRT). Response time compensation (RTC), also known as "overdrive" (OD) technology, may be used to reduce GLRT and improve or reduce motion blur.

The OD method can be implemented using a matrix grey level's Look-Up Table (LUT). For example, a 17×17 LUT may be suitable for an 8-bit panel. Because an 8-bits panel has 256 grey levels, and each grey to each grey transition is associated with an OD grey level, there are 272 OD values in the 17×17 LUT.

When using the OD method, however, an overshoot and/or undershoot effect is inevitably introduced which can significantly impact the human visual system (HVS)'s perception and lead to motion blur or inverse ghosting. On one hand, weak OD with zero-or-less overshoot and/or undershoot does not eliminate the trailing motion artifact and/or ghosting effect which leads to motion blur. On the other hand, strong OD can introduce serious overshoot and/or undershoot effects on the pixel images to cause inverse ghosting where double image, or even color mismatch artifact is observed and leads to poor user experience.

By increasing OD intensity, a balance point may be found between the two boundary conditions: response time and image artifact. Due to complex artifact detection of human vision system, however, getting best balance between response time improvement and artifact minimization usually requires manually fine tuning. A 17×17 LUT needs 272 manual settings and a 33×33 LUT needs 1056 manual settings, which is time consuming, subjective, and dependent on the observer.

To address these, and other issues, systems and methods described herein may enable automatically finding a balanced target OD grey level for each grey-to-grey transition while quantifying the overshoot and/or undershoot impact on image motion artifact of visual perception. These techniques provide an algorithm for automated LUT generation, which may be implemented within an LCD display.

In some embodiments, systems and methods described herein may provide a quantitative analysis to evaluate HVS's image motion artifact from subjective judgement to a standard such as, for example, an International Commission on Illumination (CIE) standard (e.g., CIEDE2000). These systems and methods introduce the concept that different grey scale level may take different just-noticeable difference (JND) into consideration. In some cases, an OD LUT table may be generated using a Numerical Integration technique or a Definite Integration technique. As such, these system and methods may save time and eliminate confusion or uncertainty regarding balancing the response time versus image quality by considering HVS (human vision system)'s JND and visual temporal integration.

In some cases, these systems and methods may perform measurements twice (native GLRT and corrected GLRT) for a grey-scale matrix, which dramatically saves time for the LUT generation. Moreover, the corrected GLRT verification measurement is optional as the techniques described herein calculate grey-level response time automatically.

In some cases, systems and methods described herein may enable a customer to further customize or tune an LCD panel's response time according to their own vision perception preferences, and therefore enhance their user experience. Furthermore, these systems and methods provide a manner to evaluate panel OD capability in the very early phases of product development. When using the Definite Integration technique, for example, GLRT may be predicted based on a native response time table, even without physical panel readiness.

For purposes of this disclosure, an Information Handling System (IHS) may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an IHS may be a personal computer (e.g., desktop or laptop), tablet computer, mobile device (e.g., Personal Digital Assistant (PDA) or smart phone), server (e.g., blade server or rack server), a network storage device, or any other suitable device and may vary in size, shape, performance, functionality, and price. An IHS may include Random Access Memory (RAM), one or more processing resources such as a Central Processing Unit (CPU) or hardware or software control logic, Read-Only Memory (ROM), and/or other types of nonvolatile memory.

Additional components of an IHS may include one or more disk drives, one or more network ports for communicating with external devices as well as various I/O devices, such as a keyboard, a mouse, touchscreen, and/or a video display. An IHS may also include one or more buses operable to transmit communications between the various hardware components.

Turning to FIG. 1, a block diagram illustrating an example of components of an Information Handling System (IHS) configured go generate an overdrive look-up table (LUT) for response time compensation of a display device is depicted according to some embodiments. As shown, IHS 100 includes a plurality of processing components, including LCD panel 104 disposed in a housing 122. In various implementations, video artifacts related to "smearing" or "ghosting" of motion video as displayed on LCD panel 104 can be mitigated while reducing the number of computational cycles and graphics controller power overhead.

Components of IHS 100 may include, but are not limited to, processor 102 (e.g., central processor unit or "CPU"), input/output (I/O) device interface 104, such as a display, a keyboard, a mouse, and associated controllers, hard drive or disk storage 106, various other subsystems 108, network port 110, and system memory 112. Data is transferred between the various system components via various data buses illustrated generally by bus 114. Video optimizer system 118 couples I/O device interface 104 to LCD display panel 120, as described in more detail below.

In some implementations, IHS 100 may not include each of the components shown in FIG. 1. In other implementations, IHS 100 may include other components in addition to those that are shown in FIG. 1. Furthermore, some components that are represented as separate components in FIG. 1 may instead be integrated with other components. For example, all or a portion of the functionality provided by two or more discrete components may instead be provided by components that are integrated into processor(s) 100 as a systems-on-a-chip.

Figure 2A:
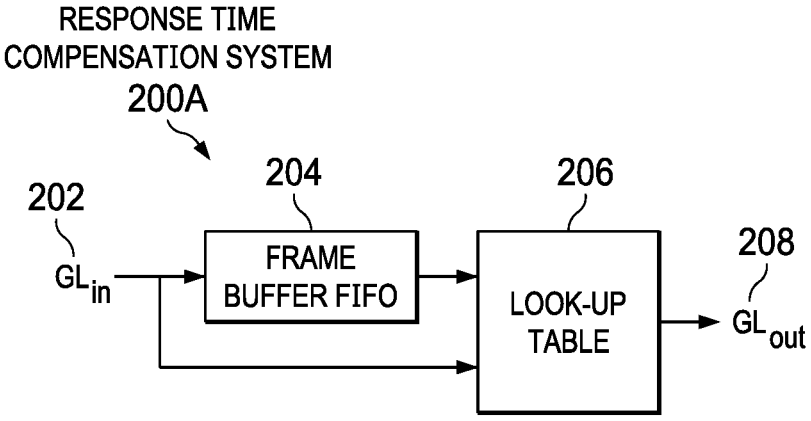
FIG. 2A is a block diagram of an example of a Response Time Compensation (RTC) system, according to some embodiments.

FIG. 2A is a block diagram illustration of a Response Time Compensation (RTC) system 200A as generally implemented with frame buffer 204 and look-up table (LUT) 206. A digital video stream is intercepted by RTC system 200 and stored in first-in-first-out (FIFO) frame buffer 204. An incoming grey level command (GLin) 202 is compared to the current grey level command and a predetermined alternate grey level is chosen from look-up table (LUT) 206. The chosen grey level value is then issued as outgoing grey level command (GLout) 208, which can be used for response compensation. The compensation can result in either over-driven or under-driven voltages being applied.

FIG. 2B is an example of overdrive (OD) LUT 200B to illustrate an implementation of LUT 206 of FIG. 2, according to some embodiments. In this 17×17 LUT, 17 "from" grey levels 0-255 (vertical) are mapped to 17 "to" grey levels 0-255 (horizontal). Each column/row intersection contains, for a particular "from/to" combination, a predetermined OD grey level. For example, if the initial grey level is 176 and the target grey level is 208, the OD grey level value is set to 216 to provide an overshooting boost or compensation. Conversely, if the initial grey level is 96 and the target grey level is 48, the OD grey level value is set to 33 to provide an undershooting boost or compensation.

Figure 3:
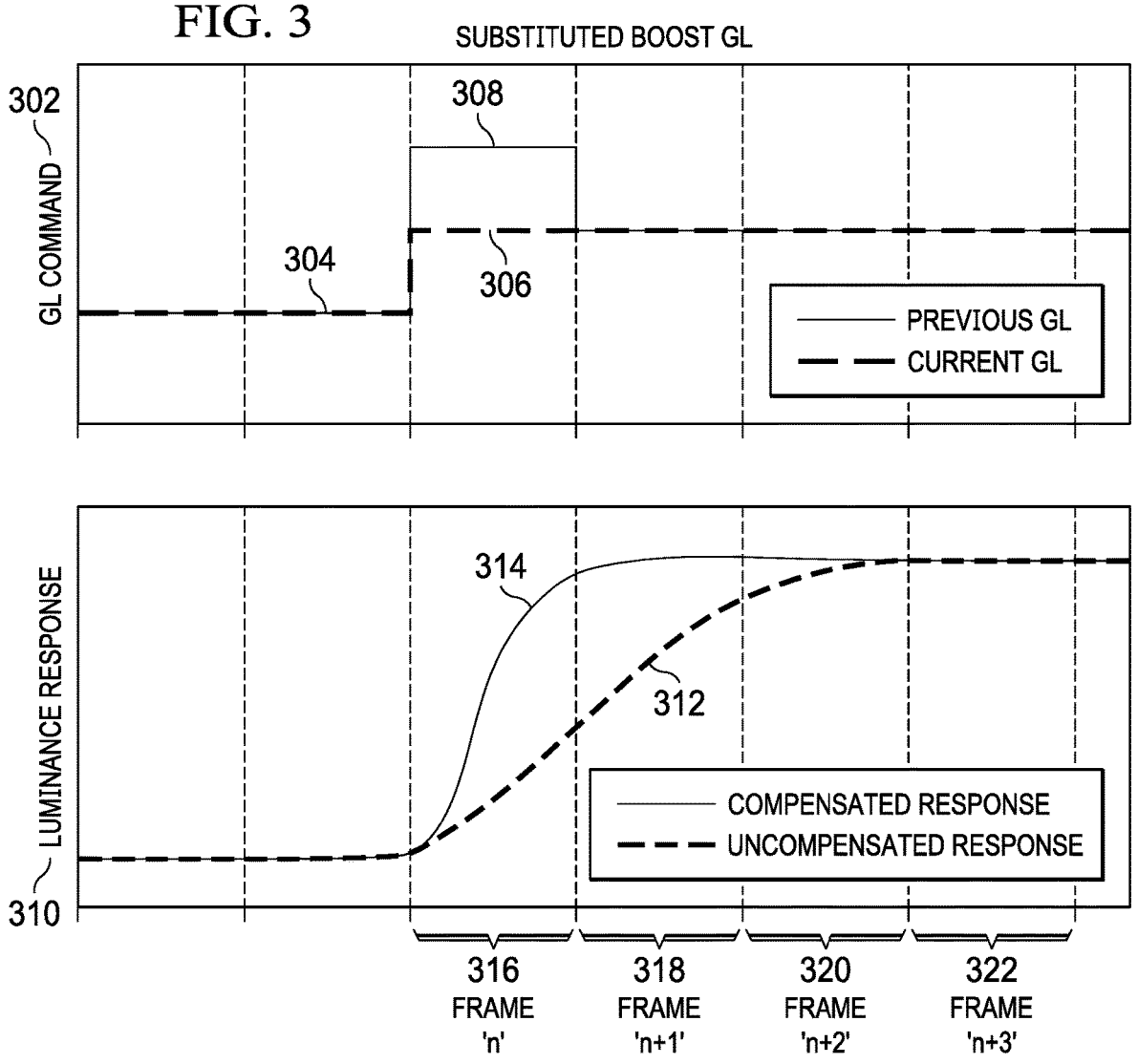
FIG. 3 is a block diagram illustration of the application of an RTC compensation value, according to some embodiments.

FIG. 3 is a block diagram illustration of the application of an RTC compensation value according to some embodiments. An incoming digital video stream comprising grey level commands 302 is processed by RTC system 200 as discussed above. When LUT 206 determines that the previous grey level command 304 is different from current grey level command 306, a predetermined compensation value is applied as substituted grey level boost command 308 to Frame 'n' 316. When the substituted grey level boost command 308 is applied to frame 'n' 316, luminance response 310 results in compensated response 314.

In this example, compensated response 314 rises substantively to the desired luminance level within Frame 'n' 316 and reaches stability within Frame 'n+1' 318, whereas uncompensated response 312 rises to the desired luminance level over Frames 'n' 316, 'n+1' 318, and 'n+2' 320 before reaching stability in Frame 'n+3' 322, thereby producing video artifacts resulting in smearing between frames of motion video.

Figure 4:
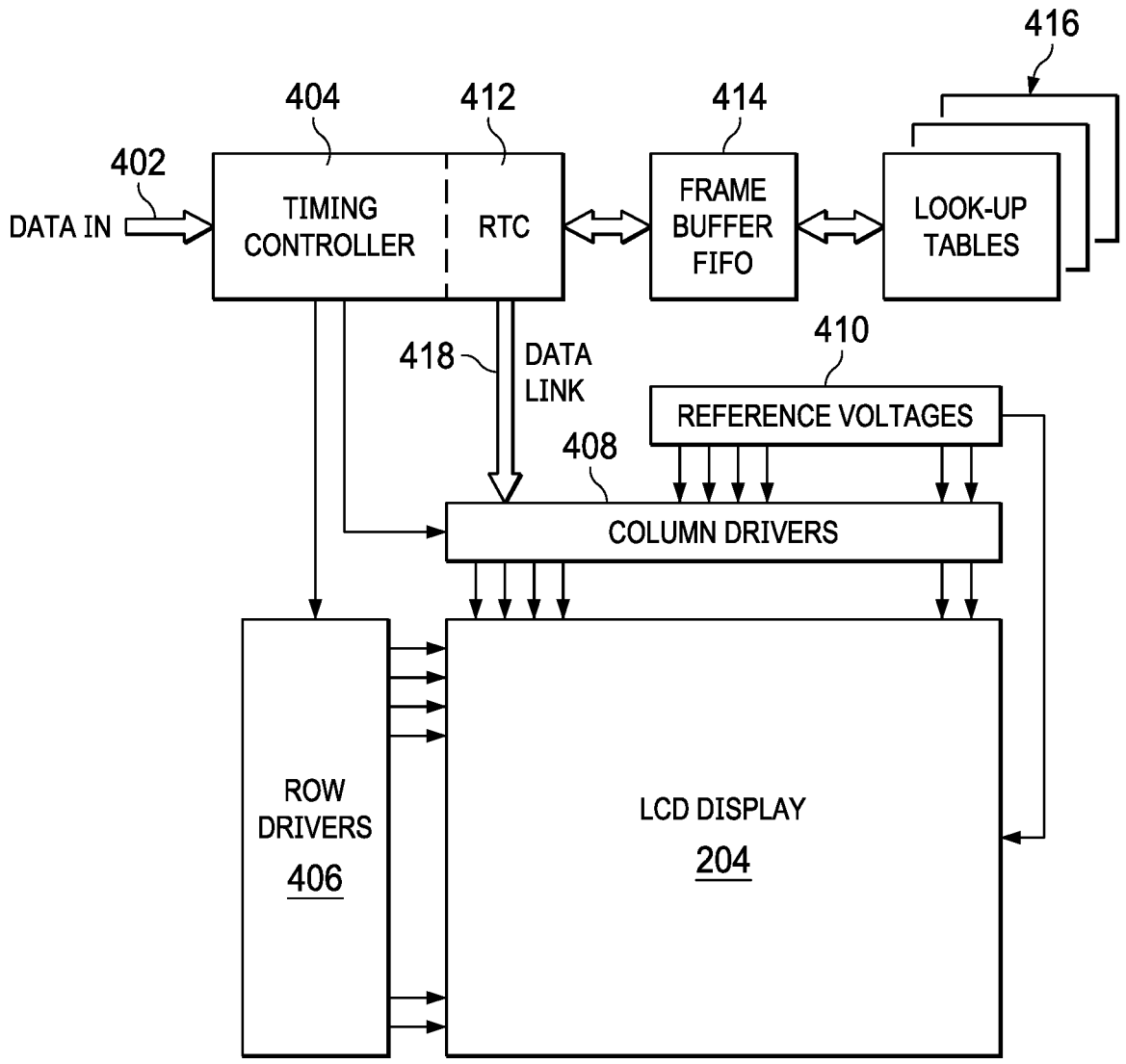
FIG. 4 is a block diagram illustration of an embodiment of an RTC system, according to some embodiments.

FIG. 4 is a block diagram illustration of an embodiment of a Response Time Compensation (RTC) system 412 as generally implemented with timing controller 404, FIFO frame buffer 414, and LCD display panel 204. LCD display panel 204 comprises row drivers 406 and column drivers 408. Reference voltages 410 are supplied to column drivers 408 and LCD display panel 204 in a resistive-string, digital-to-analog converter (RDAC), column-driven architecture.

Timing controller 404 is coupled to row drivers 406 and column drivers 408, which map grey level values to voltage nodes on a series resistance string. Column drivers 408 predetermine the voltage needed at each node to achieve the associated brightness level required to produce the intended grey level value. As grey level commands in digital video stream data 402 are received by timing controller 404, RTC logic 412 retrieves the previous grey level to the corresponding element within the video data stream from FIFO frame buffer 414.

Simultaneously, RTC logic 412 stores the current grey level in FIFO frame buffer 414 for use in the next frame. RTC logic 412 then compares the current and previous grey level commands for each separate red, green and blue (RGB) element using separate RGB look-up tables 416. The contents of RGB look-up tables 416 provide a unique grey level surrogate for each pairing of current and previous grey level commands, which is used to calculate the value of grey level substituted boost 308.

Grey level substituted boost 308 commands are communicated by RTC logic 412 through data link 418 to column drivers 408, which then produce an override, or "over-drive" command to deliver appropriate higher voltage to the voltage node. Delivering the higher voltage results in compensated response 314, thereby reducing video artifacts that can contribute to smearing of video images containing motion.

In other embodiments, RTC 412, FrameBuffer FIFO 414, and Look-Up Tables 416 may all be implemented within a scalar processor, which may be disposed outside of the LCD panel module. In those cases, the data input into timing controller 404 may be RTC-processed. That is, the scalar processor may complete the RTC and then pass processed data to timing controller 404 for LCD display panel 204 to render.

In various embodiments, systems and methods described herein may employed to: capture an LCD panel's native response time and its overdrive response time, and to auto-generate an overdrive LUT based on those measurements. For example, a hardware system may include a grey level photo sensor, test IHS, and a display. A method used to generate an overdrive LUT may be based on an HVS's vision perception, luminance temporal integration, and just-noticeable difference (JND) (e.g., derived from CIEDE2000). Particularly, such a method may control the total temporal luminance stimulus received on observer's HVS to be equivalent as the luminance integrated by ideal grey level transition with an error/offset range of JND ($\Delta E_{00}$).

Figure 5:
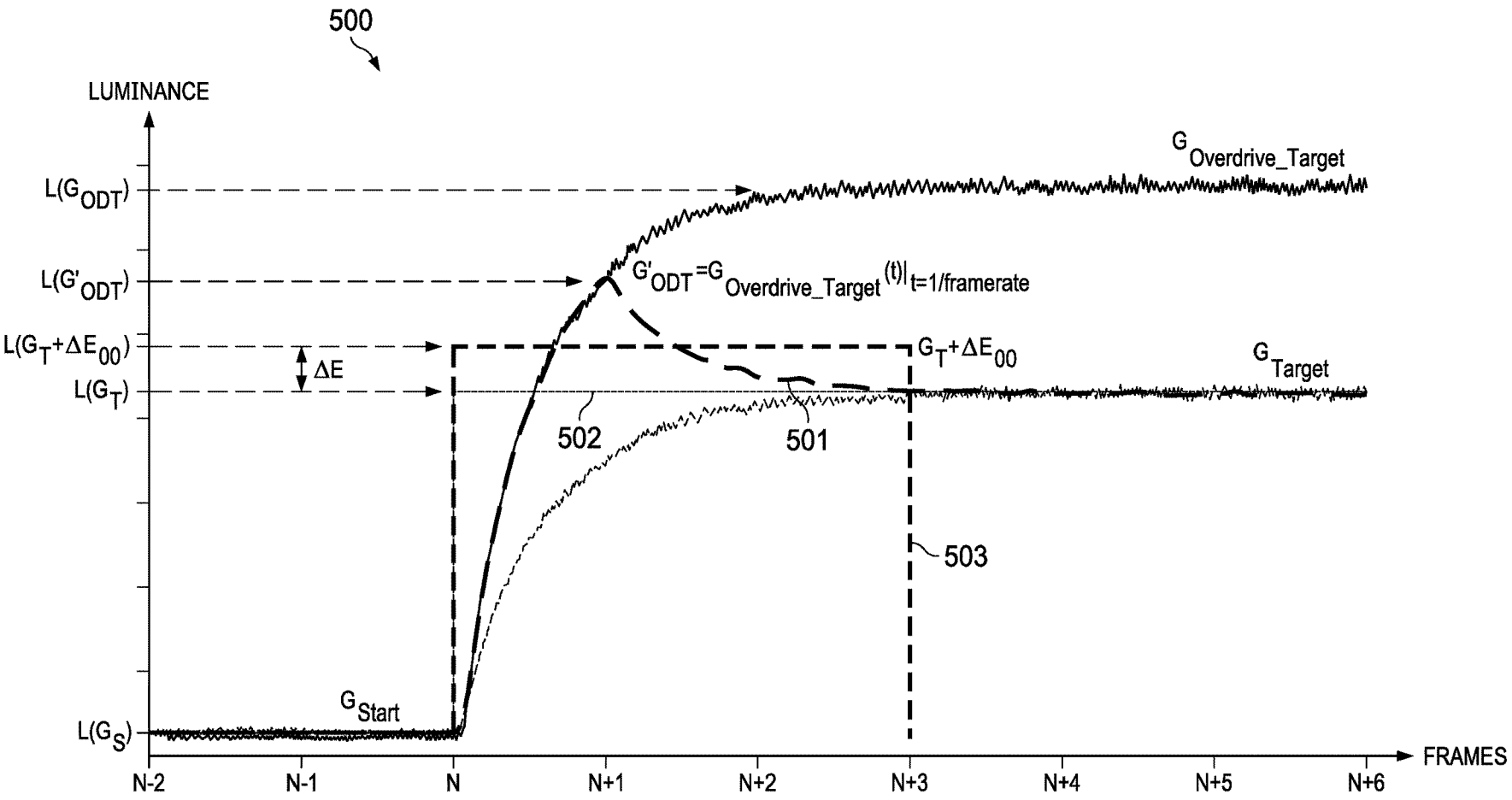
FIG. 5 is a graph of an example of an overdriven grey level response curve (GLRC), according to some embodiments.

FIG. 5 shows graph 500 of an example of an overdriven grey level response curve (GLRC), according to some embodiments. As a characteristic of an HVS, brightness stimulus is the temporal integration for most of Smooth Pursuit Eye Movements (SPEM) where fits end-user application, such as objective tracking in FPS games.

In FIG. 5, $G_{Start}(G_S)$ is the starting initial grey level, $G_{Target}(G_T)$ is the ending target grey level, $L(G_S)$ is luminance of $G_S$ grey level and $G_{Overdrive_Target}$ $(G_{ODT})$ is the selected OD grey level. An overdriven grey level transition from $G_{Start}(G_S)$ to $G_{Target}(G_T)$, shown as curve 501, is made of 2 segments: the first frame (from N to N+1) follows the native GLRC from $G_{Start}(G_S)$ to $G_{Overdrive_Target}(G_{ODT})$, and the rest frames (from N+1 onwards) follow another native GLRC from $G_{Overdrive_Target}(G_{ODT})$ to $G_{Target}(G_T)$, where: $G_{Overdrive_Target}$ $(G_{ODT})$ is the equivalent Grey level at $1^{st}$ frame-end of GLRC from $G_S$ to $G_{ODT}$, defined below:

$$L(G_{ODT}')=GLRC_{G_S\to G_{ODT}}(t)|_{t=1/Framerate} \quad \text{Equation 1}$$

Thus, the over-driven GLRC 501 is given by:

$$OD_{G_S\to G_T}(t)=\begin{cases} GLRC_{G_S\to G_{ODT}}(t), & 0\le t\le 1/Framerate \\ GLRC_{G'_{ODT}\to G_T}(t), & t\ge 1/Framerate \end{cases} \quad \text{Equation 2}$$

As seen, in FIG. 3, overdrive can introduce overshoot/undershoot lasting for several frames (up to 3-4 frames per today's panel technology), which is also a temporal luminance stimulus integration on observer's HVS. Stronger overdrive leads to additional higher/lower luminance in the period of overshoot/undershoot, and those temporal integrations on the HVS causes inverse ghosting artifact on vision perception. Conversely, a weak/zero overdrive does not allow the observer's HVS to receive enough luminance in the period of pixel transition and therefore causes motion blur/tailing feeling. In an ideal case, an HVS would receive the exact luminance of the "N+1" frame with infinite small (i.e., "0") response time, shown as curve 502.

To minimize artifacts, it becomes necessary to control the total temporal luminance stimulus received on observers' HVS to be equivalent as the luminance integrated by the ideal grey level transition. Moreover, due to the difference between individual HVSs, an error/offset margin ($\Delta E$) may be introduced, shown as curve 503, ($\Delta E$) to further improve the response time.

Figure 6:
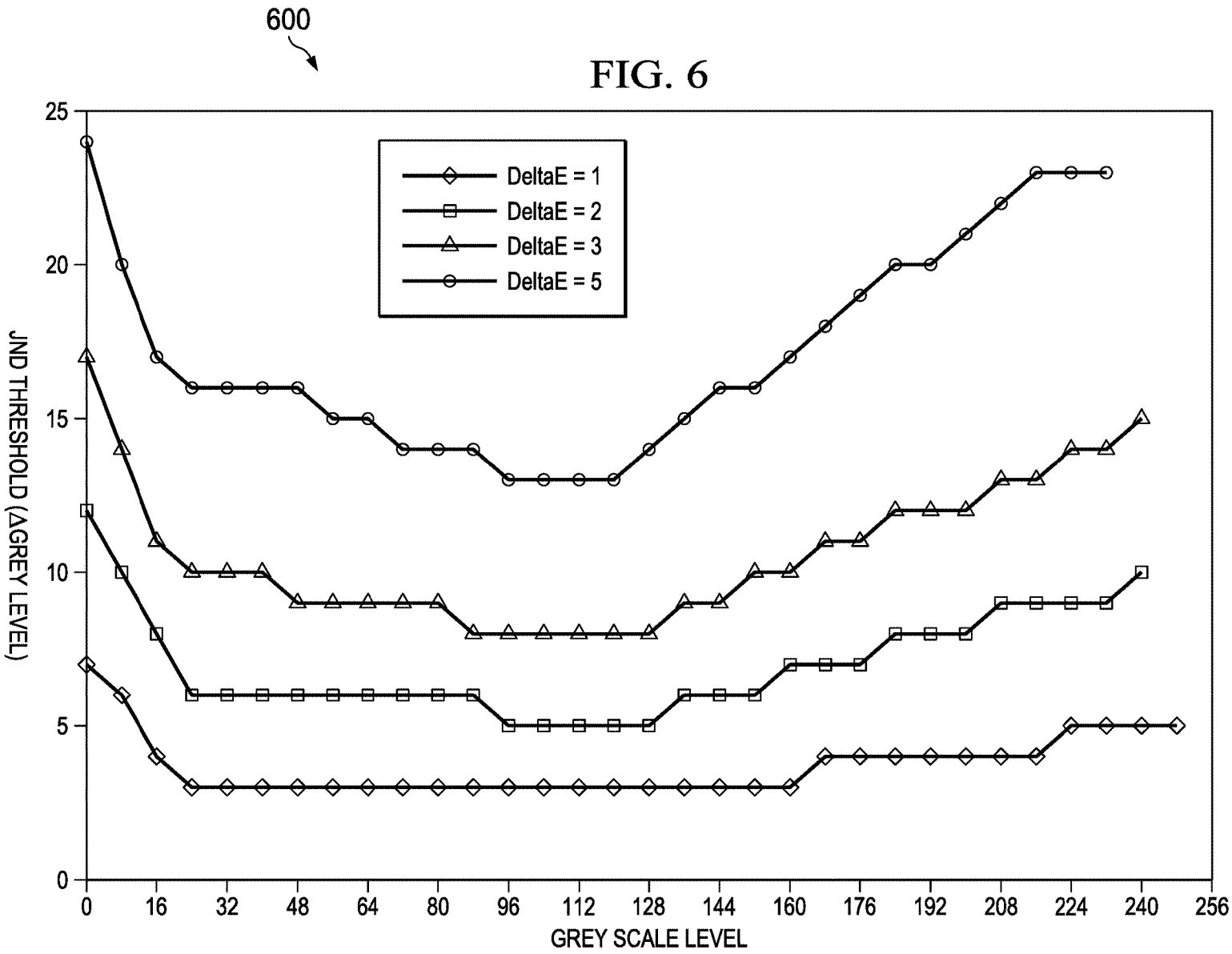
FIG. 6 is a graph of examples of grey level just-noticeable difference (JND) thresholds, according to some embodiments.

FIG. 6 shows graph 600 of examples of grey level just-noticeable difference (JND) thresholds. In some embodiments, color differences may be quantified using $\Delta E$ to simulate different HVS's JND. It is noted that for different grey level, the HVS has different tolerance JND under same $\Delta E$. And JND threshold level can be expressed in the format of delta grey-level $\Delta G$. Thus, for each different grey level (GL), the JND threshold can be described as a delta grey-level $\Delta G$ in the function of $\Delta E$, shown as below $$JND_{GL}=\Delta G_{GL}(\Delta E) \quad \text{Equation 3}$$

To meet the total temporal luminance stimulus received by the observer's HVS to be equivalent as the luminance integrated by ideal grey level transition with the error/offset range of JND derived from $\Delta E_{00}$ (CIEDE2000), the equation for calculating each overdriven grey level ($G_{ODT}$) value in the OD LUT:

$$\left(\frac{1}{Framerate}+Ts_{(G'_{ODT}\to G_T)}\right)*L(G_T+\Delta G_T(\Delta E))=\int_0^{1/Framerate} GLRC_{G_S\to G_{ODT}}(t)dt+\int_0^{Ts_{(G'_{ODT}\to G_T)}} GLRC_{G'_{ODT}\to G_T}(t)dt \quad \text{Equation 4}$$

where $Ts_{(G_{ODT}'\to G_T)}$ is the settling time from grey level $G'_{ODT}$ to ending target grey level $G_T$. The left side of equation 4 provides for the integration of two time-segments (first frame plus target grey level's luminance stabilized settling time) of ideal ending target grey level plus delta grey of the ending grey level's $\Delta E$. The right side of equation 4 provides for the integration of overdriven response curve from $G_S$ to $G_T$, which includes two segments integration of: (i) from starting grey level to overdrive grey level, and (ii) from overdrive's $1^{st}$ frame-end equivalent grey level to ending grey level.

Figure 7:
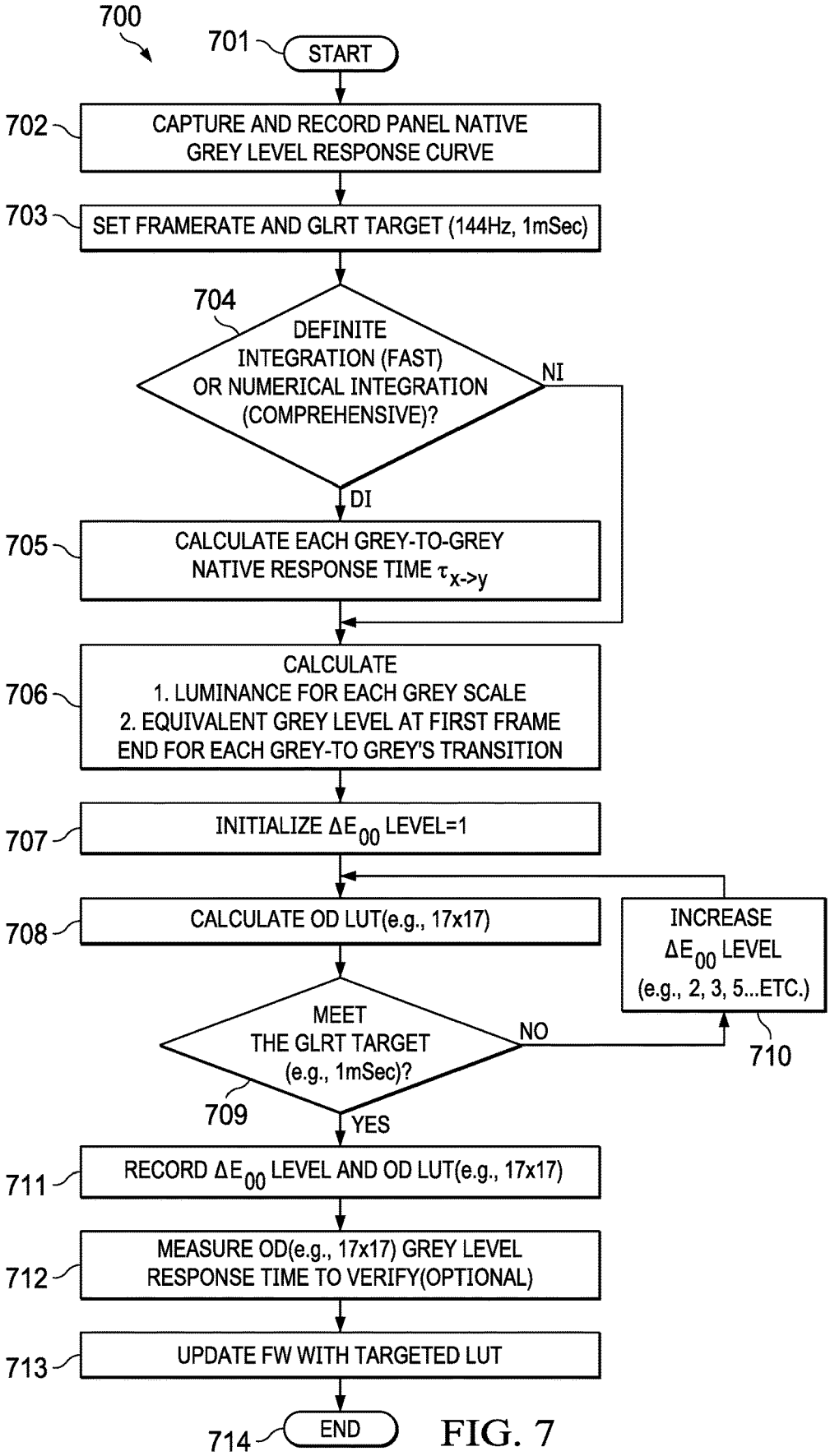
FIG. 7 is a flowchart of an example of a method for generating an overdrive LUT for response time compensation of a display device, according to some embodiments.

FIG. 7 is a flowchart of an example of method 700 for generating an overdrive LUT for response time compensation of a display device. In some embodiments, method 700 operates in three stages: first, method 700 captures an LCD panel's native GLRC by capturing raw database with limited grey-scale matrix (e.g., 65×65 for an 8-bit panel) and/or performs an interpolation full grey-scale matrix (e.g., 255×255 for an 8-bit panel). Second, method 700 calculates the OD LUT automatically by: setting an GLRT target and framerate (e.g., 1 ms @ 144 Hz), choosing an integration scheme (fast DI or comprehensive NI) and determining its parameters, and auto-calculating by increasing $\Delta E00$ step-by-step until the GLRT target is met. Third, method 700 may optionally measure GLRT to verify it and/or to generate a report.

At block 701, method 700 starts. At block 702, method 700 captures and records an LCD panel's native GLRC across each grey-to-grey response and records it as panel native raw database. Each native GLRC is the temporal function of luminance changes. The final luminance is given by:

$$L(G)=L(0)+[L(255)-L(0)]*\left(\frac{G}{255}\right)^{Gamma} \quad \text{Equation 5}$$

The GLRC may be stored in the format of greyscale matrix which full matrix size is depends on color bit-depth, e.g., 255×255 for an 8-bit panel as full matrix. Due to a non-linear liquid crystal temporal response, the larger the matrix size recorded the better the OD LUT optimization. In some cases, to balance capturing process time and accuracy, an interpolation may be used. For example, a 65×65 measured matrix with interpolation may be used to predict the full 255×255 GLRC matrix for an 8-bit panel.

At block 703, method 700 sets a framerate for the video stream being processed, and a GLRT target (e.g., 144 Hz, 1 ms). To calculate the integration of each grey-to-grey level transition, block 704 selects a Definite Integration (DI) technique or a Numerical Integration (NI) technique. The integral function of DI is obtained by curve fitting all GLRC after native raw database captured at block 702, then used to calculate equation 4 to find each suitable $G_{ODT}$ to generate the OD LUT. Meanwhile, NI directly calculates the integral from the native GLRC raw data. It should be noted that DI has less accuracy due to non-linear liquid crystal temporal response, but it takes slightly less time to generate OD LUT compared with NI. In some cases, DI may be programed as fast option while NI is offered a comprehensive option, selectable via a user interface or the like.

At block 705, method 700 calculates each grey-to-grey native response time ($\tau_{(x\to y)}$). At block 706, method 700 calculates a luminance for each grey scale and an equivalent grey level at first frame end for each grey-to-grey transition. At block 707, method 700 initializes $\Delta E_{00}$ to a "1" value. At block 708, method 700 may calculate an OD LUT, for example, using equation 4 above. At block 709, method 700 determines whether the GLRT target is met. If not, block 710 increases or increments the $\Delta E_{00}$ level (e.g., $\Delta E_{00}$="2," and so on) and control returns to block 708. Otherwise, at block 711, method 700 records the current $\Delta E_{00}$ level and the current OD LUT.

Optionally, at block 712, method 700 measures the OD GLRT to verify it. Upon verification, block 713 may update the display's firmware with the targeted LUT before method 700 ends at block 714.

Referring back to block 704, when direct integration technique is selected, each grey-to-grey's GLRC is the luminance function of time and can be expressed as any equation, for example can be curve fitted as, but not limited to, equation 6 (with R2=0.98) below:

$$GLRC_{x\to y}(t) = L(x) + [L(y) - L(x)] * \left(1 - e^{-\frac{t}{p(x\to y)}}\right) \quad \text{Equation 5}$$

In equation 6, "X" is start grey level and "Y" is target ending grey level. L(x) or L(y) may be derived from equation 5. $P_{(x\to y)}$ is parameter dedicatedly related to X-to-Y's GLRC. Moreover, $$GLRC_{x\to y}(t)|_{t=0}=L(x), GLRC_{x\to y}(t)|_{t=\infty}=L(y) \quad \text{Equation 6}$$

In some cases, the response time is defined as the time from 10% to 90%. Here, t90 and t10 are defined as the time where luminance reaches 90% and 10% respectively, shown as follows:

$$\tau_{(x\to y)}=t_{90}-t_{10} \quad \text{Equation 7}$$

For 10% of luminance from X grey to Y grey (e.g., from 128 to 192), then equation 6 is settled as follows:

$$GLRC_{x\to y}(t_{10}) = 10\% * L(x) + [L(y) - L(x)] = L(x) + [L(y) - L(x)] * \left(1 - e^{-\frac{t_{10}}{p(x\to y)}}\right) \quad \text{Equation 8}$$

Similarly, for 90% of luminance, equation 6 is settled as follows:

$$GLRC_{x\to y}(t_{90}) = 90\% * L(x) + [L(y) - L(x)] = L(x) + [L(y) - L(x)] * \left(1 - e^{-\frac{t_{90}}{p(x\to y)}}\right) \quad \text{Equation 9}$$

From equations 9 and 10, we ascertain that:

$$\begin{cases} \ln 0.9 = -\dfrac{t_{10}}{p_{(x\to y)}} \\ \ln 0.1 = -\dfrac{t_{90}}{p_{(x\to y)}} \end{cases}$$

From equation 8, $$T_{(x\to y)}=t_{90}-t_{10}=P_{(x\to y)}*(\ln 0.9-\ln 0.1)=p_{(x\to y)}*\ln 9$$

Therefore, parameter P(x→y) may be described as:

$$p_{(x\to y)} = \frac{\tau_{(x\to y)}}{\ln 9} \quad \text{Equation 10}$$

Finally, the response curve of X grey to Y grey may be expressed as follows:

$$GLRC_{x\to y}(t) = L(x) + [L(y) - L(x)] * \left(1 - e^{-\frac{t*\ln 9}{\tau(x\to y)}}\right) \quad \text{Equation 11}$$

Where:

L(x): Luminance of initial Grey x;

L(y): Luminance of target grey Y; and $\tau_{(x\to y)}$: Native response time from grey X to grey Y.

Thus, each grey-to-grey response curve can be expressed in the one equation with 3 parameters: L(x), L(y), and $\tau_{(x\to y)}$, which can easily be obtained from GLRC captured in block 702 of method 700.

The stabilized settling time Ts may be defined as the time takes for the luminance to change from 0.1% to 99.9%($\tau_{(x\to y)999}$) or from 0.01% to 99.99%($\tau_{(x\to y)9999}$), and the relationship to $T_{(x\to y)}$ is as shown below:

$$Ts_{99.9}\%=\tau_{(x\to y)999}=P_{(x\to y)}*\ln 999=3.14*\tau_{(x\to y)} \quad \text{Equation 12}$$

$$Ts_{99.99}\%=T_{(x\to y)9999}=P_{(x\to y)}*\ln 9999=4.19*\tau_{(x\to y)} \quad \text{Equation 13}$$

Assuming that the stabilized settling time Ts is from 0.1% luminance to 99.9% luminance, then equation 4 becomes:

$$\left(\frac{1}{Framerate} + 3.14 * \tau_{(G'_{ODT}\to G_T)}\right) * L(G_T + \Delta G_T(\Delta E)) = \int_0^{1/Framerate} GLRC_{G_S\to G_{ODT}}(t)dt + \int_0^{3.14(G'_{ODT}\to G_T)} GLRC_{G'_{ODT}\to G_T}(t)dt \quad \text{Equation 14}$$

where, $GLRC_{G_S\to G_{ODT}}(t) = L(G_S) + [L(G_{ODT}) - L(G_S)] * \left(1 - e^{-\frac{t*\ln 9}{\tau_{G_S\to G_{ODT}}}}\right)$ and $GLRC_{G'_{ODT}\to G_T}(t) = L(G'_{ODT}) + [L(G_T) - L(G'_{ODT})] * \left(1 - e^{-\frac{t*\ln 9}{\tau(G'_{ODT}\to G_T)}}\right)$ Moreover, once $G_{ODT}$ has been identified, OD response time may be derived as:

$$\tau_{OD(G_S \to G_T)} = \frac{\tau_{(G_S \to G_{ODT})}}{\ln 9} * \ln\left(\frac{L(G_{ODT}) - 0.9 * L(G_S) - 0.1 L(G_T)}{L(G_{ODT}) - 0.9 * L(G_T) - 0.1 L(G_S)}\right) = \frac{\tau_{(G_S \to G_{ODT})}}{\ln 9} * \ln\left(\frac{K - 0.1}{K - 0.9}\right) \quad \text{Equation 15}$$

where, $$K = \frac{L(G_{ODT})}{L(G_T)} \quad \text{Equation 16}$$

Because the framerate and all GLRC values are known, for each $G_S \to G_T$, the only variables are $G_{ODT}$ and $\Delta E$, so method 700 may auto-calculate the suitable $G_{ODT}$ to meet target response time $T_{OD(G_S \to G_T)}$ by starting from lowest $\Delta E$ to minimize the artifact.

Still referring to block 704, when the numerical integration technique is selected, method 700. May utilize the native GLRC to calculate the integration without using curve fitting GLRC equations, without introducing curve fitting errors. Based on equation 4, once the framerate is fixed, all parameters are known from the native GLRC raw database to determine the suitable GODT for each of Grey-to-Grey OD to achieve target response time $T_{OD(G_S \to G_T)}$ requirement within the limited $\Delta E$ range.

It should be understood that various operations described herein may be implemented in software executed by processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

The terms "tangible" and "non-transitory," as used herein, are intended to describe a computer-readable storage medium (or "memory") excluding propagating electromagnetic signals; but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including, for example, RAM. Program instructions and data stored on a tangible computer-accessible storage medium in non-transitory form may afterwards be transmitted by transmission media or signals such as electrical, electromagnetic, or digital signals, which may be conveyed via a communication medium such as a network and/or a wireless link.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An Information Handling System (IHS), comprising:

a controller; and a memory coupled to the controller, the memory having program instructions stored thereon that, upon execution, cause the controller to generate a Look-up Table (LUT) of alternate grey levels selected to implement Response Time Compensation (RTC) in a Liquid Crystal Display (LCD), wherein calculation of at least one of the alternate grey levels takes into account a frame rate of a video stream, and wherein to generate the LUT, the program instructions, upon execution, further cause the controller to:

set an offset margin value;

calculate the LUT using the offset margin value; and at least one of:

(a) in response to application of the LUT meeting or exceeding a Grey Level Response Time (GLRT) target, record the LUT; or (b) in response to application of the LUT not meeting the GLRT target, increment the offset margin value and recalculate the LUT using the incremented offset margin value.

2. IHS of claim 1, wherein calculation of the at least one of the alternate grey levels takes into account a quantified measure of image motion artifacts.

3. The IHS of claim 1, wherein to generate the LUT, the program instructions, upon execution, further cause the controller to use: (i) a numerical integration technique, or (ii) a definite integration technique.

4. The IHS of claim 1, wherein to generate the LUT, the program instructions, upon execution, further cause the controller to calculate each grey-to-grey transition native response time.

5. The IHS of claim 1, wherein to generate the LUT, the program instructions, upon execution, further cause the controller to calculate: (i) a luminance for each gray scale level, and (ii) an equivalent grey scale level at the end of a first frame following each grey-to-grey transition.

6. A memory storage device having program instructions stored thereon that, upon execution by a controller of a Liquid Crystal Display (LCD), cause the LCD to:

receive a video stream; and generate a Look-up Table (LUT) of alternate grey levels selected to implement Response Time Compensation (RTC), wherein at least one of the alternate grey levels is calculated, at least in part, by taking into account a quantified measure of image motion artifacts, and wherein to generate the LUT, the program instructions, upon execution, further cause the LCD to:

set an offset margin value;

calculate the LUT using the offset margin value; and at least one of:

(a) in response to application of the LUT meeting or exceeding a Grey Level Response Time (GLRT) target, record the LUT; or (b) in response to application of the LUT not meeting the GLRT target, increment the offset margin value and recalculate the LUT using the incremented offset margin value.

7. The memory storage device of claim 6, wherein calculation of the at least one of the alternate grey levels takes into account a frame rate of a video stream.

8. The memory storage device of claim 6, wherein to generate the LUT, the program instructions, upon execution, further cause the controller to use: (i) a numerical integration technique, or (ii) a definite integration technique.

9. The memory storage device of claim 6, wherein to generate the LUT, the program instructions, upon execution, further cause the controller to calculate each grey-to-grey transition native response time.

10. The memory storage device of claim 6, wherein to generate the LUT, the program instructions, upon execution, further cause the controller to calculate: (i) a luminance for each gray scale level, and (ii) an equivalent grey scale level at the end of a first frame following each grey-to-grey transition.

11. In a Liquid Crystal Display (LCD), a method comprising:

receiving a video stream; and generating a Look-up Table (LUT) of alternate grey levels selected to implement Response Time Compensation (RTC), wherein at least one of the alternate grey levels is calculated, at least in part, by taking into account: (i) a frame rate of a video stream, or (ii) a measure of image motion artifacts, and wherein the LUT is generated, at least in part, by: (i) setting an offset margin value; (ii) calculating the LUT using the offset margin value; and at least one of: (iii) in response to application of the LUT meeting or exceeding a Grey Level Response Time (GLRT) target, recording the LUT; or (iv) in response to application of the LUT not meeting the GLRT target, incrementing the offset margin value and recalculating the LUT using the incremented offset margin value.

12. The method of claim 11, wherein the LUT is generated, at least in part, using: (i) a numerical integration technique, or (ii) a definite integration technique.

13. The method of claim 11, wherein the LUT is generated, at least in part, by calculating each grey-to-grey transition native response time.

14. The method of claim 11, wherein the LUT is generated, at least in part, by calculating: (i) a luminance for each gray scale level, and (ii) an equivalent grey scale level at the end of a first frame following each grey-to-grey transition.

* * * * *